US005586420A

United States Patent [19]

Harris

[11] Patent Number: 5,586,420

[45] Date of Patent: Dec. 24, 1996

[54] METHOD AND APPARATUS FOR FILLING STRUCTURAL HOLES

[76] Inventor: Olan D. Harris, 7404 Zoar, Lubbock, Tex. 79424

[21] Appl. No.: 128,479

[22] Filed: Dec. 7, 1993

[51] Int. Cl.[6] ..... F04G 23/02

[52] U.S. Cl. ..... 52/514.5; 52/514; 52/DIG. 1; 52/742.14; 52/749.13; 15/235.3; 401/193; 222/611.2

[58] Field of Search ..... 52/514, 514.5, 52/743, 749, DIG. 1, 436; 222/611.2; 401/193, 5; 294/3.5; 15/235.3, 235.4

[56] References Cited

U.S. PATENT DOCUMENTS

| | | | |
|---|---|---|---|
| 16,021 | 11/1856 | Phillips | 401/193 X |
| D. 354,879 | 1/1995 | Ullmann | D7/312 X |
| 1,851,497 | 3/1932 | Darling | 15/235.3 X |
| 2,622,434 | 12/1952 | Rutka | 52/749 |
| 3,162,886 | 12/1964 | Wise | 401/193 |
| 3,764,222 | 10/1973 | Orthman | 222/611.2 X |
| 4,511,063 | 4/1985 | Krause et al. | 294/3.5 X |
| 4,709,526 | 12/1987 | Crumby | 52/DIG. 1 X |
| 4,972,886 | 11/1990 | Bernstein . | |
| 5,117,605 | 6/1992 | Waldbeiser . | |
| 5,125,814 | 6/1992 | Lester | 222/611.2 X |

*Primary Examiner*—Carl D. Friedman
*Assistant Examiner*—Winnie Yip
*Attorney, Agent, or Firm*—Novak Druce Reynolds Burt

[57] ABSTRACT

Apparatus and method for filling holes and other flaws in substantially planar surfaces such as walls and floors of structural buildings. The invention includes an independent template having a bore therethrough. An alternative embodiment comprises a filler material receiving tray, a bottom portion of which is a template with a bore therethrough and constructed integrally therewith. A tapered and funnel shaped rim is provided to an exterior of the bore for insertion into the hole to be filled. Additionally, an extension tube may be provided for conveying the filler material to holes and recesses below a planar surface. It is contemplated that a mixing and storage section may be constructed integrally therewith for the filler material prior to distribution through the bore.

12 Claims, 3 Drawing Sheets

METHOD AND APPARATUS FOR FILLING STRUCTURAL HOLES

BACKGROUND OF THE INVENTION (1) Field of the Invention

This invention relates generally to a repair kit and more particularly to an apparatus and method for filling structural holes using a template with a bore therethrough and a means for holding structural filling material.

(2) Background of the Invention

Holes and flaws are common occurrences in structural surfaces such as interior walls, brick facades of a buildings, and wooden decking. Multiple holes may occur from activities such as insect extermination treatments which may necessitate hundreds of holes to be drilled into a structure. Individual holes may result from the removal of screws, bolts and nails from these surfaces.

Holes and flaws can lead to a diminution of the attractiveness and value of the structure. Repair of these types of holes or flaws needs to be accomplished in a clean and precise manner so as to maintain the structure's attractiveness and value.

Common methods of hole repair typically involve pouring or applying a filler material into the hole or flaw with a putty knife. This often leads to excess filler material blemishing the surface or creating protrusions that must subsequently be removed to maintain the character of the surface.

An example of a hole repair kit is given in U.S. Pat. No. 5,117,605 entitled "Repair Device for Aiding in Restoring Damaged Dry Wall, Sheet Rock or Plaster Board" issued to Waldbeiser. Waldbeiser uses a support rod to hold a variable sized plate in position behind the hole to effectuate repair of holes in walls of hollow construction. After the complex assembly, the plate and shaft become a permanent support of the wall and therefore are not reusable.

U.S. Pat. No. 4,972,886 entitled "Ice Distribution System" issued to Bernstein discloses an ice distribution tray having a plurality of apertures formed through the bottom of the tray in a pattern to match a set assembly of glasses in order to facilitate delivery of ice to the glasses. This invention only addresses ice distribution in an expedient manner.

The related art described in the patents listed above and the common methods of hole repair fail to address the needs of clean, precise, and inexpensive structural hole repair in a way that conserves filler material. The related art also lacks a method or apparatus that provides for a clean, precise and rapid repair of hundreds of holes such as occur during termite extermination. The present invention addresses these needs and provides further advantages detailed hereinafter.

SUMMARY OF THE INVENTION

The present invention is directed to an apparatus and a method for filling a structural hole. The apparatus includes a template with a bore therethrough and a filler receiving means. The filler receiving means can be represented by a filler holding tray which allows for the template to sit within the filler holding tray while the repair is taking place. The apparatus can also employ an extension tube which is attached to the template bore and which allows for the filling of holes recessed below a planar surface or upon a non-planar surface.

The method of filling structural holes is accomplished by placing the template adjacent to a structural surface with a hole therein. Then aligning the template bore with the structural surface hole and applying a structural filling material to the surface hole through the template bore.

It is therefore an object of the present invention to provide a novel apparatus to repair structural holes in a precise, efficient and clean manner.

A further object of the present invention is to provide an inexpensive apparatus to conserve filler material while repairing structural holes.

Still a further object of the present invention is to provide an inexpensive apparatus to repair a large number of structural holes in a rapid, precise and clean manner.

Other objects, features and advantages will become apparent in the course of a detailed description of the present invention.

DETAILED DESCRIPTION OF THE INVENTION

Figure 1:
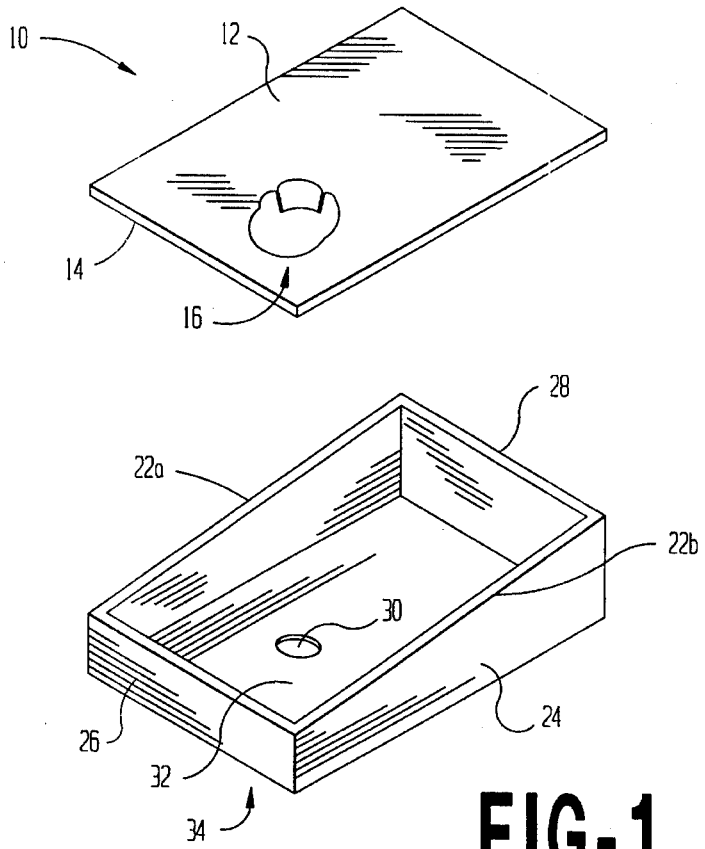
FIG. 1 is a perspective view of a structural hole filling apparatus in accordance with one embodiment of the present invention.
Figure 2:
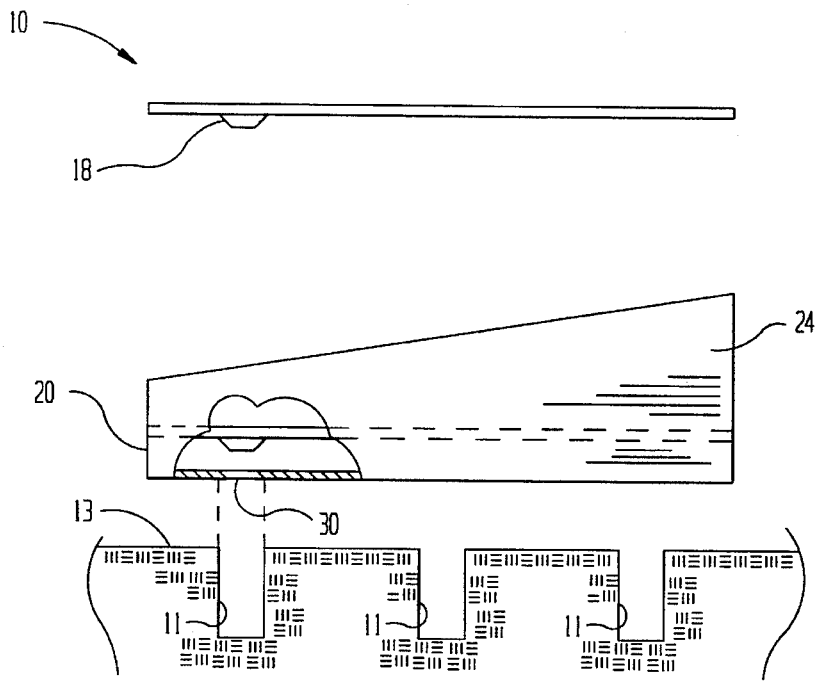
FIG. 2 is an elevational view of FIG. 1.

FIG. 1 is a top perspective view and FIG. 2 is a side perspective view of a structural hole filling apparatus in accordance with one embodiment of the present invention. In FIGS. 1 and 2, a template 10 is substantially flat, rectangular in shape and includes an upper template surface 12, a lower template surface 14 and a template bore 16 therethrough about which a rim 18 is formed at the lower surface 14. The bore 16 is located near one end of two shorter sides of the rectangular template 10 and is equidistant between longer sides of the template 10. The bore 16 of each template 10 is sized according to the hole 11 to be filled. The diameter of the rim 18 is smaller than the diameter of the hole to be filled, allowing for the rim 18 to protrude into the hole.

The template 10 is designed to removably mate with a filler material receiving tray 20 which includes an upper tray surface 32 designed to mate with the lower template surface 14. Side walls **22*a* and 22*b*, forward end wall 26 and rearward end wall 28 of the receiving tray 20 provide vertical sides to the receiving tray 20 and create an open container for hole filling material. A lower tray surface 34 of the receiving tray 20 is designed to lay flush against the surface 13 to be repaired. A tray bore 30 through the receiving tray 20 is large enough to allow the rim 18 of the template 10 to pass therethrough and protrude beyond the lower surface 34 of the receiving tray 20**.

The receiving tray 20 with the template 10 positioned therein, is placed over the hole to be filled so as to allow the rim 18 to protrude therein. A filling material such as cement, spackle or putty is then applied through the bore 16 of the template 10 until the structural hole is filled. The rim 18 prevents excess hole filling material from blemishing the surface of the structure being repaired. Excess filling material above the bore 16 is then removed by scraping a putty knife or the like over the bore 16 along the upper surface 12 of the template 10. The excess filler material is contained within the receiving tray 20 by walls 22*a* 22*b*, 26 and 28 thereby allowing for a precise, efficient and clean repair of the damaged surface.

Figure 3:
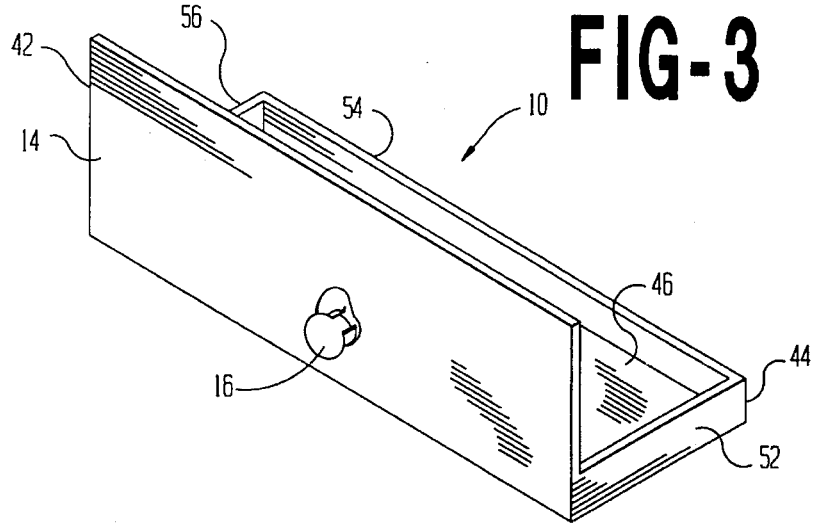
FIG. 3 is a top perspective view of a structural hole filling apparatus in accordance with one embodiment of the present invention where the template is conformed to be its own filler receiving means.
Figure 4:
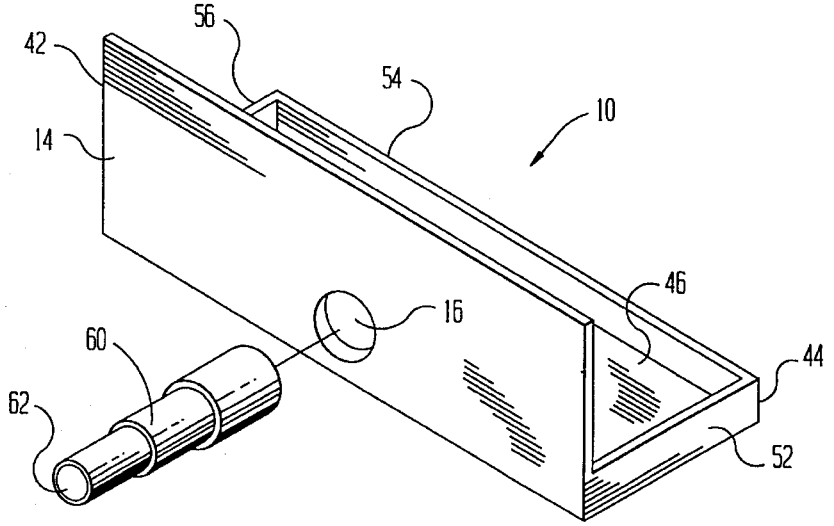
FIG. 4 is a top perspective view of a structural hole filling apparatus in accordance with one embodiment of the present invention where the template is conformed to be its own filler receiving means with an extension tube shown prior to installation.
Figure 5:
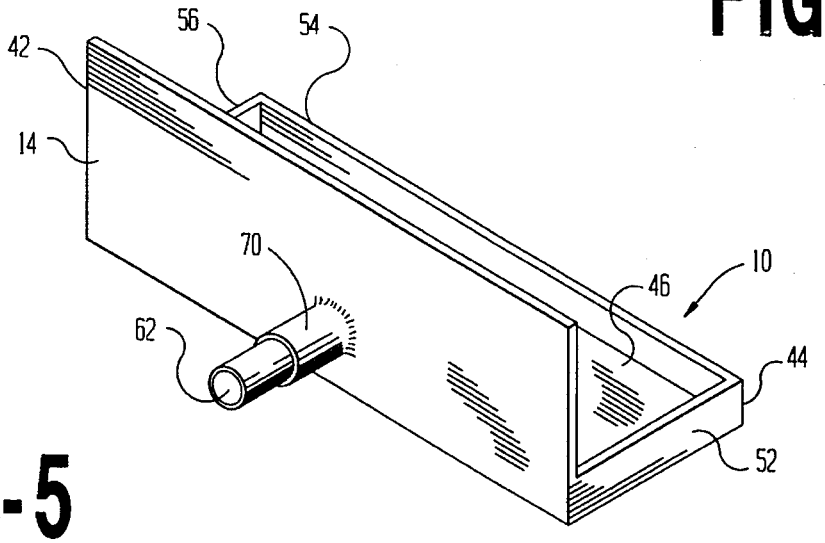
FIG. 5 is a top perspective view of a structural hole filling apparatus in accordance with one embodiment of the present invention where the template is conformed to be its own filler receiving means with an extension tube attached.

FIGS. 3–5 are top perspective views of a structural hole filling apparatus in accordance with one embodiment of the present invention where a template 10 is conformed to be its own filler receiving means. In FIG. 3 the template 10 has an upward extending portion 42 and an outward extending portion 44 which allows the template 10 to become its own filler receiving means. The bore 16 is located near the lower end of the upward extending portion 42 and above the outward extending portion 44. The angle formed between the upward extending portion 42 and the outward extending portion 44 is ninety degrees in the embodiment shown, but may be any suitable angle depending upon the surface to be repaired. The template 10 is angled at ninety degrees to provide for a precise, clean and efficient repair of holes in a vertical surface. The outward extending portion 44 has side walls 52, 54 and 56 protruding above an upper surface 46 which provides for storage and containment of the hole filling material.

FIG. 4 shows extension tube 60 which can be removably or permanently attached to the template 10 at bore 16. The extension tube 60 allows for repair of holes in non-planar or recessed surfaces such as a brick structure where the hole is located in the recessed mortar. The template 10 is placed against the outer surface of the brick while the extension tube 60 is adjusted to extend to the inner surface of the mortar where the hole to be repaired is found. The extension tube 60 is adjusted by either using a telescopic version or by slicing off the unneeded portion of extension tube 60. The filling material is then applied through bore 16 into the extension tube 60 and into the hole to be repaired with any excess filler being contained on the upper surface 46 of outward extending portion 44. Once the hole is filled, the template 10 and extension tube 60 are lifted away leaving an unblemished surface.

In FIG. 5 extension tube 60 is telescopic and is permanently sealed to the template 10. The telescopic extension tube 60 allows for rapid length adjustment of the tube 60 and allows the clean and precise repair of many structural holes in a surface of varying depths in a short period of time.

Figure 6:
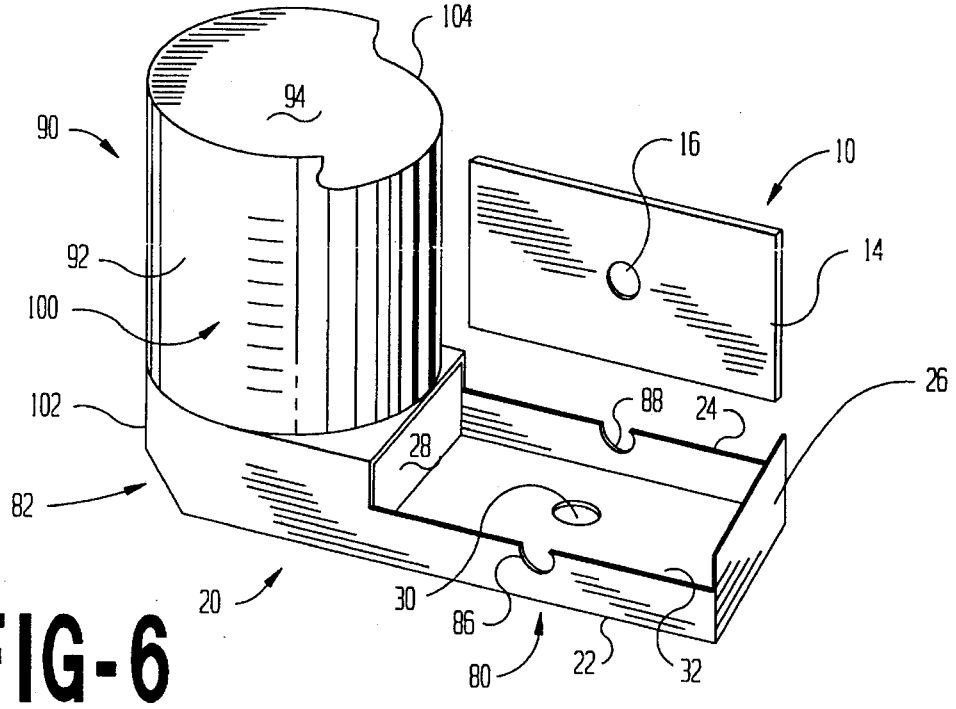
FIG. 6 is a top perspective view of a structural hole filling apparatus in accordance with the preferred embodiment of the present invention, showing the apparatus in its vertical hole repair mode.
Figure 7:
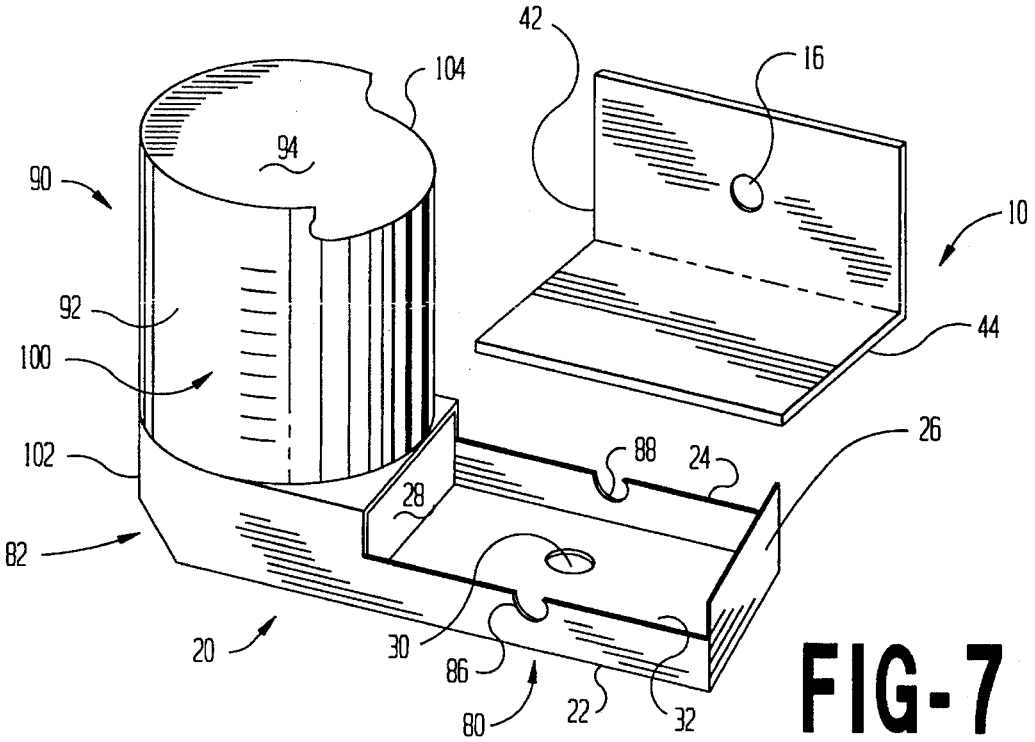
FIG. 7 is a top perspective view of a structural hole filling apparatus in accordance with the preferred embodiment of the present invention, showing the apparatus in its horizontal hole repair mode.

FIGS. 6 and 7 are top perspective views of a structural hole filling apparatus in accordance with the preferred embodiment of the present invention. In FIGS. 6 and 7, the receiving tray 20 is extended and divided into an operational section 80 and a mixing and storage section 82. This operational section 80 is rectangular with side walls 22 and 24 having semi-circular indentations 86 and 88 halfway along the length of each side wall 22 and 24. The operational section 80 has a forward end wall 26 and rearward end wall 28 higher than the side walls 22 and 24, so as to provide a means for preventing filler material from unintentionally leaving the receiving tray 20.

The storage section 82 has a rounded container 90 extending upward from and secured to the receiving tray 20. The container 90 has a circumferential wall 92 surrounding a hollow interior 94. The top of the container 90 is open to allow for input and output of filler material. The circumferential wall 92 has markings 100 for measuring the amount of filler material to be utilized in the repair of the hole. The top portion of the circumferential wall 92 facing the operational section 80 of the receiving tray 20, has an indentation 104 to allow for removal of excess filler material from a putty knife or the like by scrapping across a top lip of the indentation in a manner that causes the excess filler to remain within the hollow interior 94 where it is contained therein. The receiving tray 20 has a reinforced end wall 102 surrounding the container 90 and along with the rearward end wall 28, forms a firm base for secure placement of the container 90 on the receiving tray 20. The container 90 is used for mixing and storage of the filler material, and as a support and lift means during use of the present invention.

In the preferred embodiment, the bore 30 of the receiving tray 20 is positioned so as to allow for the rim 18 of the template 10 to protrude from the bore 30 as the lower surface 14 of the template 10 is securely mated with the upper surface 32 of the receiving tray 20. When there is a need for rapid repair of a plurality of vertical holes in a horizontal surface, a substantially flat template 10 is utilized as shown in FIG. 6.

When there is a need for rapid repair of a plurality of horizontal holes in a substantially vertical surface, a template 10 having an upward extending portion 42 and an outward extending portion 44 is utilized as shown in FIG. 7. The template 10 has a bore 16 located near the lower end of the upward extending portion 42 with a rim surface 18 which protrudes from the semi-circular indentations 86 or 88 as the lower surface 14 of the template 10 is securely installed upon the upper surface 32 of the receiving tray 20.

The basic operation of the preferred embodiment of the present invention begins with the necessity to repair a plurality of holes such as the hundreds of holes drilled during termite extermination. The appropriate template 10 is selected with the rim 18 sized to protrude into the holes to be filled. In the preferred embodiment, the rim can protrude into holes on-half to three-quarters of an inch in diameter, however, the filling of any size hole of the nature previously described is contemplated. The template 10 is secured onto the receiving tray 20 with the rim 18 protruding through either the bore 30 for repair of vertical holes in a horizontal surface, or the indentation 86 or 88 for repair of horizontal holes in a substantially vertical surface. Then the required amount of filler material is placed into the container 90. If necessary, the filler material is mixed in the container 90. Then an operator grips the container 90 and positions the receiving tray 20 near the hole to be filled. The receiving tray 20 is placed on the sur#ace so as to allow the rim 18 to protrude into the hole to be filled. The operator, still gripping the container 90 with one hand, uses a putty knife or the like, to remove the filler material from the container 90. The filler material is then forced through the bore 16 into the hole to be filled. Any excess filler material is removed by scraping over the bore 16 with the putty knife. The receiving tray 20 is then removed from the surface leaving a precisely filled hole without excess filler material blemishing the surrounding surface. The receiving tray 20 is then positioned over the next hole and the process is repeated.

Persons skilled in the art may readily adapt the teachings of the present invention to embodiments and methods differing from those described and illustrated herein. Therefore, the present invention should be limited only in accordance with the appended claims.

What is claimed is:

1. A structural hole filling apparatus comprising:

a structural hole filler having a filler receiving means for receiving and holding a structural filler material;

a template having a template bore engagable with said filler receiving means, said bore for passing structural filler material from within said receiving means into a structural hole located exterior to said receiving means;

said template bore having a lip surface that defines a rim that protrudes below a lower surface of said filler receiving means;

said filler receiving means comprising a filler receiving tray having at least one bore therethrough and a plurality of edges designed to hold the structural filler material therein;

said receiving tray having an upper surface and a lower surface;

said receiving tray upper surface designed to removably engage said template lower surface; and said rim of said template being adapted to be insertable through said bore of said filler receiving tray;

said receiving tray lower surface being designed to mate with structural surfaces to be filled.

2. The structural hole filling apparatus according to claim 1 wherein said template is substantially flat.

3. A structural hole filling apparatus comprising:

a structural hole filler having a filler receiving means for receiving and holding a structural filler material;

a template engagable with said filler receiving means;

said template having at least one bore therethrough for passing structural filler material from within said receiving means into a hole exterior to said filler receiving means;

said template bore having a lip surface at said template;

said lip surface defining a rim that protrudes form a side surface of said template;

said template bore sized to be insertable into a hole to be filled with structural filler material;

said template forms an angle having an upward extending portion and an outward extending portion;

said upward extending portion of said template having a lower end;

said outward extending portion of said template connected to said template upward extending portion at said lower end; and said template bore being positioned through said template upward extending portion of said template.

4. The structural hole filling apparatus according to claim 3 wherein an angle formed by a connection between said template upward extending portion and said template outward extending portion is ninety degrees.

5. The structural hole filling apparatus according to claim 4 wherein:

a lower surface of said outward extending portion of said template being removably mateable with an upper surface of said receiving tray; and said rim of said template which protrudes from said side surface thereby forming a semi-circular indentation for filing of holes in a non-horizontal surfaces.

6. The structural hole filling apparatus according to claim 3 further comprising:

a hollowed extension tube;

said extension tube having an external diameter smaller than said diameter of said template bore; and said extension tube designed and positioned arranged to sealably mate with said template bore opposite said template outward extending portion of said template.

7. The structural hole filling apparatus according to claim 6 wherein said extension tube is permanently attached to said template.

8. The structural hole filling apparatus according to claim 6 wherein said extension tube is removably positioned in said template bore.

9. A structural hole filling apparatus according to claim 6 wherein said extension tube is arranged to facilitate a change in a length of said extension tube.

10. A structural hole filling apparatus according to claim 9 wherein said extension tube is telescopic.

11. A method of repairing structural surfaces having a hole therein, the method comprising the following steps:

positioning a receiving means for structural filler adjacent to a structural surface having a hole therein, said receiving means having a bore therethrough for dispensing structural filler from within said receiving means;

inserting a template having a template bore into said receiving means so that said template bore is aligned with the bore of said receiving means;

aligning said bores of the receiving means and the template with the hole in the structural surface; and applying a structural filler material to said structural hole through said bores.

12. The method of repairing structural surfaces having a hole therein according to claim 11, said method further comprising forming a structural filler material passage from said receiving means to said structural surface hole by positioning an extension tube between said template bore and said surface hole.

* * * * *